US006142439A

United States Patent [19]

Aramaki

[11] Patent Number: 6,142,439

[45] **Date of Patent: *Nov. 7, 2000**

[54] LIFTING APPARATUS

[75] Inventor: Noriyoshi Aramaki, Kawaguchi, Japan

[73] Assignee: Aramaki Technica Co., Ltd., Kawaguchi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,668

[22] Filed: Dec. 31, 1997

[30] Foreign Application Priority Data

Jan. 20, 1997 [JP] Japan ..... 9-000972
May 6, 1997 [JP] Japan ..... 9-115781

[51] Int. Cl.[7] ..... A47H 1/10

[52] U.S. Cl. ..... 248/327; 248/328

[58] Field of Search ..... 248/327, 328, 248/317, 329, 331, 332; 362/386, 402, 403, 404, 405

[56] References Cited

U.S. PATENT DOCUMENTS

| | | | |
|---|---|---|---|
| 2,609,170 | 9/1952 | Farrington et al. | 200/2 |
| 3,610,584 | 10/1971 | Pfaff, Jr. | 362/403 |
| 4,947,764 | 8/1990 | Rohr | 109/3 |
| 5,105,349 | 4/1992 | Falls et al. | 362/405 |
| 5,420,772 | 5/1995 | Evans | 362/386 |
| 5,519,597 | 5/1996 | Tsai . | |
| 5,556,195 | 9/1996 | Glebe | 362/386 |
| 5,718,531 | 2/1998 | Mutschler, Jr. et al. | 403/28 |

FOREIGN PATENT DOCUMENTS

| | | |
|---|---|---|
| 0 009 855 A1 | 4/1980 | European Pat. Off. . |
| 0 757 204 A1 | 2/1997 | European Pat. Off. . |
| 87 03 721 U | 4/1987 | Germany . |
| 2015959 | 9/1979 | United Kingdom . |

*Primary Examiner*—Ramon O. Ramirez
*Attorney, Agent, or Firm*—Oliff & Berridge, PLC

[57] ABSTRACT

A lifting apparatus for installation or maintenance of an elevated installation in order to simplify installation work and perform maintenance work at a lower place. The lifting apparatus comprises a fixed part to be fixed at a high place, and a lifting part which comprises an installation to be installed at the fixed part and a power source for at least moving up the lifting part and which is suspended from the fixed part to move up and down.

16 Claims, 12 Drawing Sheets

LIFTING APPARATUS

BACKGROUND OF THE INVENTION

1. Field of the Invention

The present invention relates to a lifting apparatus for an elevated installation, e.g., a road lamp, a lighting apparatus to be attached to a ceiling, a signal, an air conditioning system to be attached to a ceiling, an apparatus to be suspended from a ceiling for a stage and a construction having a large space, furniture, an alarm, a smoke detector and a signboard.

2. Description of Related Art

For example, when an elevated installation such as a road lamp, is installed at a high place, or when maintenance work for such an elevated installation is performed, three methods have been used conventionally: (1) a scaffold is constructed, (2) a vehicle for high lift work is used, and (3) a lifting apparatus for maintenance is installed at a high place.

However, in the above-mentioned conventional methods, there is a problem that the cost therefor is increased. Further, there is much possibility that an accident is caused because all the steps of the work are performed at a high place.

In particular, in the case where a lifting apparatus for maintenance is installed at a high place as described in the above item (3), when the lifting apparatus itself fails, for example, a scaffold must be constructed as described in the above item (1) or a vehicle for high lift work must be used as described in the above item (2) in order to repair the lifting apparatus.

SUMMARY OF THE INVENTION

Accordingly, an object of the present invention is to provide a lifting apparatus by which installation work at a high place is simplified, an installation to be elevated can be installed at a high place after the installation to be elevated has been attached to the lifting apparatus at a low place, for example, on the ground, and an elevated installation can be lowered for maintenance work at a low place.

Another object of the present invention is to provide a lifting apparatus which can be subjected to maintenance work at a low place by lowering the lifting apparatus even if the lifting mechanism fails.

In accordance with one aspect of the present invention, the lifting apparatus comprises; a fixed part to be fixed at a high place, and a lifting part which comprises an installation to be installed at the fixed part and a power source for at least moving up the lifting part and which is suspended from the fixed part to move up and down.

Here, a high place means a position at which installation and maintenance work is impossible to perform or cannot be performed easily from a low place, for example, from the ground, for example, such as a street pole, a general ceiling, and a ceiling of a large-space structure such as a dome type space, an arena, a multipurpose hall and the like.

The installations installed at such a high place include a road lamp, a lighting apparatus to be attached to a ceiling, a signal, an air conditioning system to be attached to a ceiling, an apparatus suspended from a ceiling of a stage and a construction having a large space, furniture and the like.

For example, the lifting part incorporates various pieces of equipment including the power source for lifting operation into a lifting frame; however, the specific configuration of the lifting part can be formed optionally.

Therefore, not a large-size nor heavy weight is required for the fixed part to be installed at a high place. The installation work at a high place is simplified. Further, an installation to be elevated can be attached to the lifting part at a low place, for example, on the ground and then can be lifted to be installed at a high place.

Furthermore, after the installation was installed at a high place, the maintenance work of the elevated installation can be performed easily by lowering the lifting part as necessary.

As the fixed part, a small and lightweight part can be used sufficiently. Therefore, dangerous work at a high place is only work for fixing the small and lightweight fixed part. As a result, such work can be simplified. Further, other works can be performed at a lower place, so that the safety of work environment can be achieved.

The lifting apparatus may comprise a locking device for locking the lifting part to the fixed part.

For example, the locking device includes a lock lever and a torsion coil spring provided in the fixed part, and a lock lever and a shape memory alloy spring provided in the lifting part. As the locking device, a lock lever, and solenoid, a return spring and the like provided in the fixed part or the lifting part may be used.

Therefore, the elevated installation which is attached to and supported by the lifting part can be held at the high place by moving up the lifting part and locking the lifting part to the fixed part by the locking device.

The locking device may comprise a releasing member for releasing the locking of the lifting part and the fixed part. The releasing member may comprise a solenoid for releasing the locking of the lifting part and the fixed part by electromagnetic force thereof. The releasing member may comprise a heater for heating the releasing member to release the locking of the lifting part and the fixed part. The releasing member may comprise a spring made of shape memory alloy, which is deformed when heated above a predetermined temperature by the heater, to release the locking.

Although, for example, a coiled compression spring is used as the spring made of shape memory alloy, a coiled extension spring or a spring having another optional shape may be used.

Further, although a coiled electric heater which generates heat by being energized is used for heating operation, another heating means may be used.

Normally, the lifting part can keep the locking state in which the lifting part is locked to the fixed part by the locking member worked by the force of the spring made of shape memory alloy. On the other hand, when the spring made of shape memory alloy is heated above a predetermined temperature, the shape of the spring made of shape memory alloy is changed to release the lifting part from the fixed part.

The releasing member may comprise a control member for controlling the releasing member by remote control.

The lifting apparatus may further comprise a power supply for supplying electric power to the releasing member. The power supply may be any one of a chargeable battery and a solar battery.

Preferably, the power source may be an electric motor. However, for example, a multi-stage cylinder unit or the like may be used.

The lifting part may be suspended by a wire member to be winched by the power source. The lifting apparatus may further comprise a speed reducer for reducing speed of the lifting part, through which the wire member is winched by the power source.

Although, for example, a gear mechanism is typical as the speed reducer, another mechanism may be used.

The winching operation is performed slowly at a predetermined speed reduction ratio by the drive of the electric motor via the speed reducer. Thereby, the lifting part is moved up slowly at a predetermined speed reduction ratio.

The lifting part may be movable down by self-weight. The lifting apparatus may further comprise a speed reducer for reducing speed of the lifting part. The lifting part may be moved down by releasing the lock of the lifting part from the fixed part.

The reeling off operation is performed by self-weight of the lifting part if the electric motor has no brake.

Therefore, when the lifting mechanism fails, the lifting part is lowered by the releasing operation of locking device, and the maintenance work can be performed at a low place.

In particular, by providing the speed reducer, the lifting part is moved down slowly by self-weight at a predetermined speed reduction ratio.

The installation may be one selected from the group consisting of a road lamp, a lighting apparatus to be attached to a ceiling, a signal, an air conditioning system to be attached to a ceiling, an apparatus to be suspended from a ceiling for a stage and a construction having a large space, furniture, an alarm, a smoke detector and a signboard.

Therefore, the present invention contributes to the safety in the installation and maintenance work for a road lamp, a lighting apparatus, a signal, an air conditioning system, an apparatus suspended from a ceiling, furniture, an alarm, a smoke detector, and a signboard at a high place.

In accordance with another aspect of the present invention, the lifting apparatus comprises: a fixed part to be fixed at a high place, a lifting part which comprises an installation to be installed at the fixed part and an electric motor for at least moving up the lifting part and which is suspended from the fixed part by a wire cable to move up and down, a locking device for locking the lifting part to the fixed part, which comprises a releasing member for releasing the locking of the lifting part and the fixed part, and a speed reducer for reducing speed of the lifting part, through which the wire cable is winched by the electric motor; wherein the lifting part is moved down by self-weight.

BRIEF DESCRIPTION OF THE DRAWINGS

The present invention will become more fully understood from the detailed description given hereinbelow and the accompanying drawings which are given by way of illustration only, and thus do not limit the present invention, and wherein.

DESCRIPTION OF THE PREFERRED EMBODIMENTS

Embodiments of a lifting apparatus in accordance with the present invention will be explained below with reference to FIGS. 1 to 17.

<First Embodiment>

Figure 1:
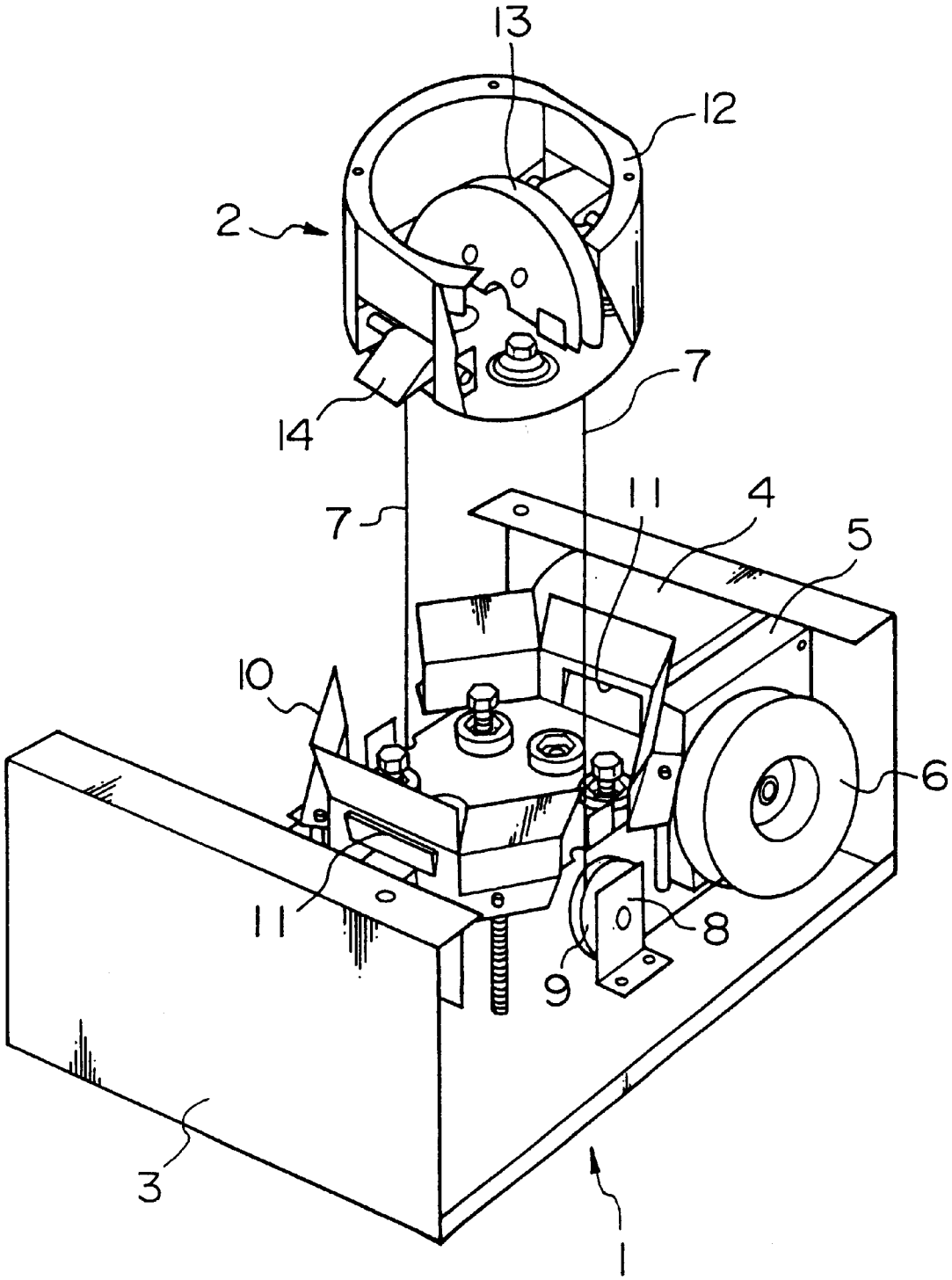
FIG. 1 is a perspective view showing a construction of a first embodiment of a lifting apparatus to which the present invention is applied.

FIG. 1 is a perspective view showing a construction of a first embodiment of a lifting apparatus to which the present invention is applied.

In FIG. 1, reference numeral 1 denotes a lifting part, 2 denotes a fixed part, 3 denotes a lifting frame, 4 denotes an electric motor (power source), 5 denotes a speed reducer, 6 denotes a driving pulley, 7 denotes a wire cable, 8 denotes a bracket, 9 denotes an intermediate pulley, 10 denotes a center case, 11 denotes a lock groove, 12 denotes an upper frame, 13 denotes a fast pulley, and 14 denotes a lock lever (locking member).

The lifting apparatus is divided into the lifting part 1 and the fixed part 2 as shown in the figure.

The lifting part 1 is equipped with the electric motor 4, which is a power source, at one side portion of the interior of the substantially box-shaped lifting frame 3. The driving pulley 6 is provided on the output axis of this electric motor 4 via the speed reducer 5 having a gear mechanism.

One end of the wire cable 7 is fixed to and wound around the driving pulley 6, and the other end thereof is fixed to one side of the central portion of the lifting frame 3. The wire cable 7 passes around the intermediate pulley 9 which is pivotally mounted to the bracket 8 erected on the other side of the central portion of the lifting frame 3, extends upwardly, and is set around the fast pulley 13 in the fixed part 2.

The center case 10 is provided in an erected manner in the central portion of the lifting frame 3. Further, a pair of opposed lock grooves 11 and 11 are formed on the inside of the center case 10.

The fixed part 2 is provided with the fast pulley 13 in an erected manner at the central portion of the interior of the substantially circular upper frame 12. The aforementioned wire cable 7 is set around the fast pulley 13 so as to be slidable by friction.

The upper frame 12 is provided with a pair of lock levers 14 and 14, i.e. locking members, which are opposed diametrically and which protrude outwardly.

The pair of lock levers 14 and 14, which engage with the pair of lock grooves 11 and 11 opposingly provided in the center case 10 of the lifting frame 3, are rotatably attached to the upper frame 12.

Further, the lock lever 14 is connected with a torsion coil spring (not shown) which normally urges the coil lever 14 in the protruding direction, and is connected also with a plunger of a solenoid for unlocking the lock lever 14 against the urging force of the torsion coil spring.

The operation of the solenoid for releasing the lock lever 14 is carried out as follows: A receiver (not shown) is mounted in the upper frame 12 of the fixed part 2. The operation of the solenoid worked by receiving electric waves given a command for lowering operation sent from a transmitter (not shown), is controlled remotely by radio transmission. In order to supply power for working the solenoid thereto, a cable reel from a power supply side is introduced to the interior of the upper frame 12, or a chargeable battery or solar battery is mounted in the upper frame 12.

The operation of the electric motor 4 in the lifting part 1 is also carried out as follows: A receiver (not shown) is mounted in the lifting frame 3. The drive of the electric motor 4 driven by receiving electric waves given a command for raising operation sent from the aforesaid transmitter, is controlled remotely by radio transmission. In order to supply power for driving the electric motor 4 thereto, a cable reel from a power supply side is introduced to the interior of the lifting frame 3, or a chargeable battery or solar battery is mounted in the lifting frame 3.

As for the weight of the lifting part 1, one of 20 kg, 50 kg, and 100 kg types and further one of a special type of over 100 kg can be prepared. Further, the electric motor 4 having a lifting capacity in accordance with the weight is used.

The electric motor 4 is of a unidirectional rotation type and has no brake.

Since the electric motor 4 is of a unidirectional rotation type, the electric motor winches the wire cable 7 around the driving pulley 6 to raise the lifting part 1.

Moreover, because of the electric motor 4 having no brake, when the power for driving the electric motor 4 is shut off when the lifting part 1 is placed at a high place and the lock lever 14 is unlocked, the electric motor 4 is rotated reversely by self-weight of the lifting part 1 via the resistance due to a predetermined speed reduction ratio of the gear mechanism of the speed reducer 5. Thereby, the lifting part 1 is lowered slowly.

As for the lifting height in the case of using the wire cable 7 winched by the drive of the electric motor 4, for example, one of 3 m to 20 m type and further one of a special type of over 20 m can be prepared. An upper limit switch (not shown) is provided on the lifting frame 3 in accordance with the lifting height. When the upper limit switch is turned on, the raising operation carried out by the electric motor 4 is halted.

The lifting frame 3 and the upper frame 12 each have an electrode, which come into contact with and separate from each other, to supply electric power to electrical equipment mounted in the lifting frame 3.

Specifically, when the lifting frame 3 is raised and reaches the upper limit position, the electrode provided on the lifting frame 3 comes into contact with the electrode provided on the upper frame 12, so that electric power is supplied to the electrical equipment mounted in the lifting frame 3. When the lifting frame 3 lowers from the upper frame 12, the electrodes are separated from each other, so that the supply of power is shut off.

When the lifting apparatus shown in FIG. 1 is installed, the wire cable 7 is extended to a maximum, and the fixed part 2 is fixed by installing the upper frame 12 at a high place by using a scaffold or a vehicle for high lift work.

Subsequently, the electric motor 4 in the lifting part 1 placed at a low place, for example, on the ground, is turned on by remote control using radio transmission. Thereby, the driving pulley 6 is rotated at a low speed via the speed reducer 5. Thereupon, the wire cable 7 is winched around the driving pulley 6 to slowly raise the lifting frame 3.

When the lifting frame 3 reaches the position of the upper frame 12 fixed at the high place, the upper limit switch is turned on, and the raising operation carried out by the electric motor 4 is halted. At the same time, the pair of lock levers 14 and 14 provided on the upper frame 12 in a diametrically opposed manner engage with the pair of lock grooves 11 and 11 provided in the center case 10 of the lifting frame 3 in an opposed manner, so that the lifting frame 3 is locked to the upper frame 12.

At this time, as described above, the electrode provided on the lifting frame 3 comes into contact with the electrode provided on the upper frame 12, so that electric power is supplied to the electrical equipment mounted in the lifting frame 3.

When maintenance work is done for routine inspection or in the event of failure, the solenoids for releasing the lock levers 14 and 14 of the upper frame 12 are turned on simultaneously by the remote control using radio transmission. Thereby, the lock levers 14 and 14 are turned against the urging force of the torsion coil spring. Thereupon, the lock levers 14 and 14 are simultaneously disengaged from the lock grooves 11 and 11 in the center case 10 of the lifting frame 3.

Thus, as described above, the electric motor 4 is rotated reversely by self-weight of the lifting part 1 via the resistance due to a predetermined speed reduction ratio of the gear mechanism of the speed reducer 5, whereby the lifting part 1 is lowered slowly.

While the lifting part 1 is placed at a low place, for example, on the ground, a predetermined maintenance work is performed.

After the maintenance work is completed, reinstallation work is performed by the same procedure as described above.

As described above, according to the lifting apparatus in accordance with the present invention, it is only necessary at a high place to fix the small and lightweight fixed part 2, so that the installation work at a high place can be simplified.

After a later-described installation to be elevated is attached to the lifting part 1 at a low place, for example, on the ground, the installation to be elevated can be installed at a high place.

Moreover, after the elevated installation is installed at a high place, the lifting part 1 can be lowered as necessary, for example, at the time of routine inspection or in the event of failure, in order to easily perform maintenance work of elevated installation including the lifting part 1.

Therefore, the safety of work environment can be achieved in the installation and maintenance work for an elevated installation.

The following is an explanation of application examples of the lifting apparatus configured as described above.

First Application Example

Figure 2:
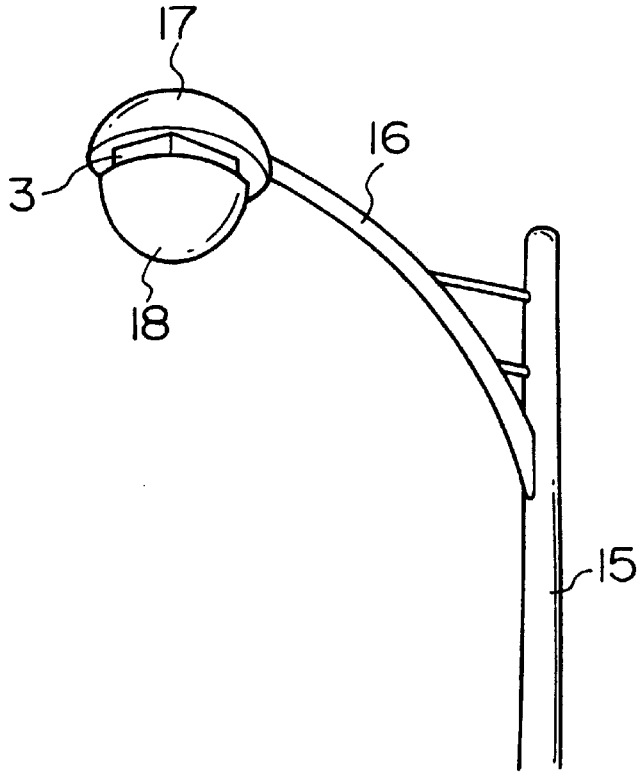
FIG. 2 is a perspective view of a ball-type of road lamp, which is a first application example of the lifting apparatus shown in FIG. 1.
Figure 3:
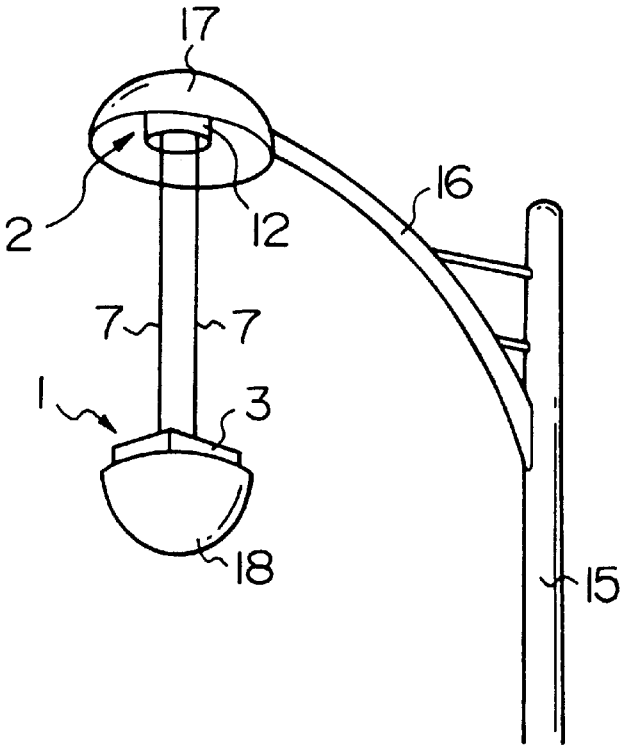
FIG. 3 is a perspective view showing a lowering operation of the road lamp shown in FIG. 2.

FIG. 2 is a perspective view of a ball-type of road lamp, which is a first application example of the lifting apparatus shown in FIG. 1. FIG. 3 is a perspective view showing a lowering operation of the road lamp.

In FIGS. 2 and 3, like the lifting apparatus shown in FIG. 1, reference numeral 1 denotes a lifting part, 2 denotes a fixed part, 3 denotes a lifting frame, 7 denotes a wire cable, and 12 denotes an upper frame. Further, reference numeral 15 denotes a street pole, 16 denotes an arm, 17 denotes a lampshade, and 18 denotes a ball-type of road lamp.

In this application example, as shown in the figures, the upper frame 12 of the fixed part 2 is attached and fixed to the interior of the lampshade 17 provided at the tip end of the arm 16 extending from the upper part of the street pole 15. On the other hand, the ball-type of road lamp 18 is attached and fixed to the lower surface of the lifting frame 3 of the lifting part 1 suspended from the upper frame 12 through the wire cable 7.

Therefore, when the installation work is performed, it is only necessary to fix the small and lightweight fixed part 2 (upper frame 12) to the lampshade 17 provided on the arm 16 at the upper part of the street pole 15. After the ball-type of road lamp 18 is attached to the lower surface of the lifting part 1 (lifting frame 3) on the ground, the ball-type of road lamp 18 can be installed to the street pole 15 by the lifting of the lifting part 1, so that the road lamp installation work can be simplified.

When the maintenance work is performed at the time of routine inspection or in the event of failure etc. after installation of the road lamp, the maintenance work of the ball-type of road lamp 18 including the lifting part 1 can be performed easily on the ground by lowering the lifting part 1.

Second Application Example

Figure 4:
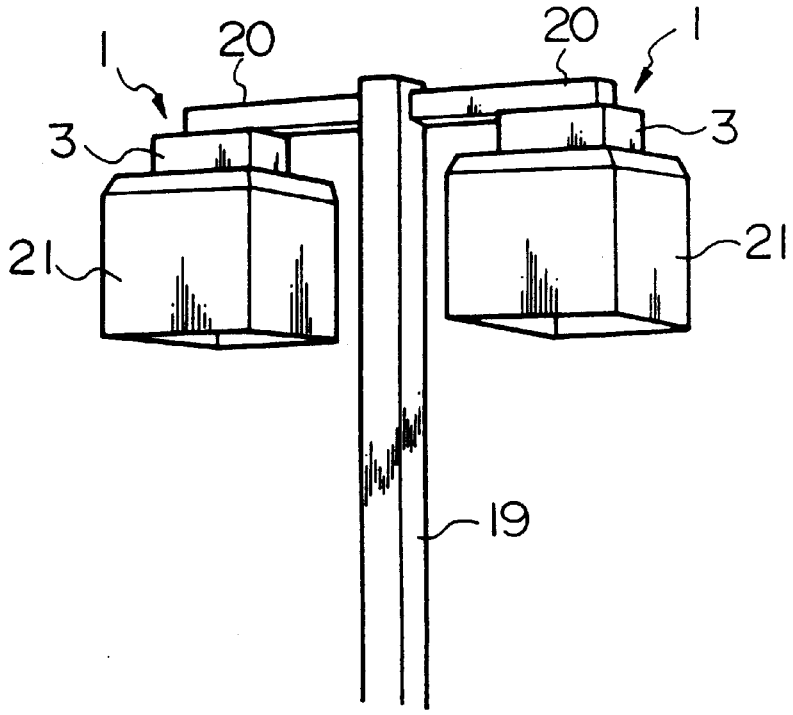
FIG. 4 is a perspective view of a set of two road lamps, which is a second application example of the lifting apparatus shown in FIG. 1.
Figure 5:
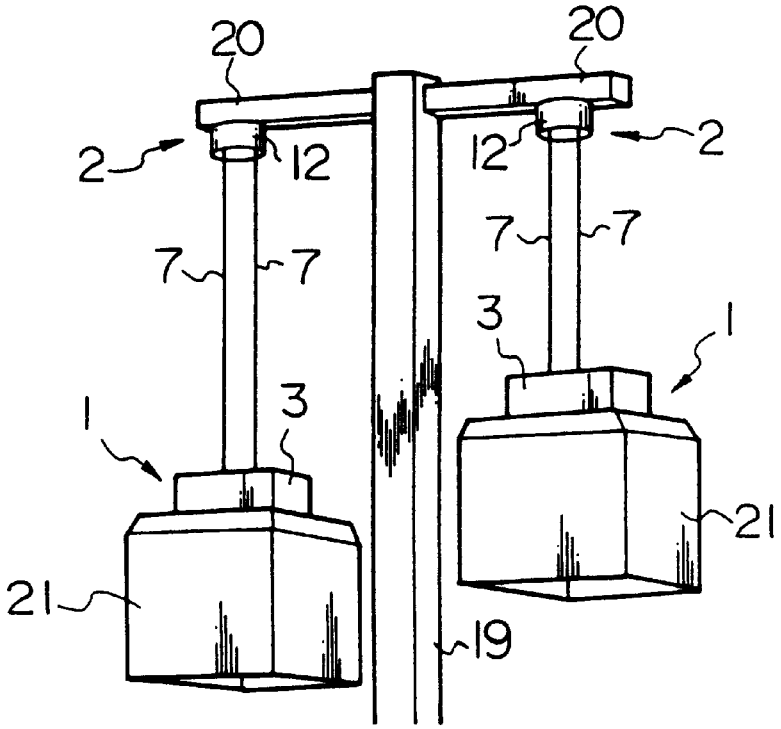
FIG. 5 is a perspective view showing a lowering operation of the road lamps shown in FIG. 4.

FIG. 4 is a perspective view of a set of two road lamps, which is a second application example of the lifting apparatus shown in FIG. 1. FIG. 5 is a perspective view showing a lowering operation of the road lamps.

In FIGS. 4 and 5, like the lifting apparatus shown in FIG. 1, reference numeral 1 denotes a lifting part, 2 denotes a fixed part, 3 denotes a lifting frame, 7 denotes a wire cable, and 12 denotes an upper frame. Further, reference numeral 19 denotes a street pole, 20 denotes an arm, and 21 denotes a box-type of road lamp.

In this application example, as shown in the figures, the upper frames 12 and 12 of the fixed parts 2 and 2 are attached and fixed to the lower surfaces of the arms 20 and 20 extending from the upper end of the street pole 19, respectively. On the other hand, the box-type of road lamps 21 and 21 are attached and fixed to the lower surfaces of the lifting frames 3 and 3 of the lifting parts 1 and 1 suspended from the upper frames 12 and 12 through wire cables 7 and 7, respectively.

Therefore, when the installation work is performed, it is only necessary to fix the small and lightweight fixed part 2 and 2 (upper frame 12 and 12) to the lower surface of the arm 20 and 20 at the upper end of the street pole 19. After the box-type of road lamp 21 and 21 is attached to the lower surface of the lifting part 1 and 1 (lifting frame 3 and 3) on the ground, the box-type of road lamp 21 can be installed to the street pole 19 by the lifting of the lifting part 1, so that the road lamp installation work can be simplified.

When the maintenance work is performed at the time of routine inspection or in the event of failure etc. after installation of the road lamp, the maintenance work of the box-type of road lamp 21 including the lifting part 1 can be performed easily on the ground by lowering the lifting part 1.

Third Application Example

Figure 6:
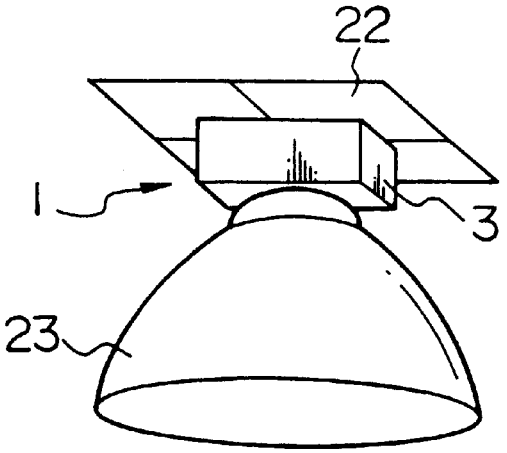
FIG. 6 is a perspective view of a ceiling-type of lighting apparatus, which is a third application example of the lifting apparatus shown in FIG. 1.
Figure 7:
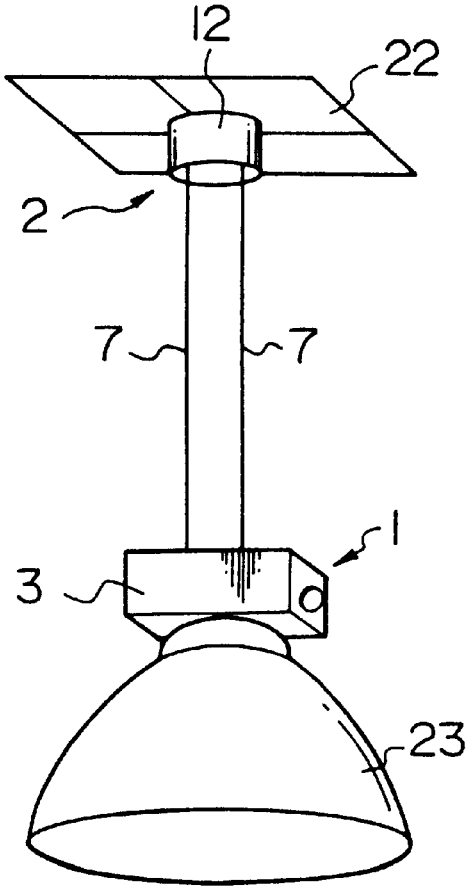
FIG. 7 is a perspective view showing a lowering operation of the lighting apparatus shown in FIG. 6.

FIG. 6 is a perspective view of a ceiling-type of lighting apparatus, which is a third application example of the lifting apparatus shown in FIG. 1. FIG. 7 is a perspective view showing a lowering operation of the lighting apparatus.

In FIGS. 6 and 7, like the lifting apparatus shown in FIG. 1, reference numeral 1 denotes a lifting part, 2 denotes a fixed part, 3 denotes a lifting frame, 7 denotes a wire cable, and 12 denotes an upper frame. Further, reference numeral 22 denotes a ceiling, and 23 denotes a lighting apparatus.

In this application example, as shown in the figures, the upper frame 12 of the fixed part 2 is attached and fixed to the ceiling 22 of a room. On the other hand, the lighting apparatus 23 is attached and fixed to the lower surface of the lifting frame 3 of the lifting part 1 suspended from the upper frame 12 through the wire cable 7.

Therefore, when the installation work is performed, it is only necessary to fix the small and lightweight fixed part 2 (upper frame 12) to the ceiling 22. After the lighting apparatus 23 is attached to the lower surface of the lifting part 1 (lifting frame 3) on a floor or a stand, the lighting apparatus 23 can be installed to the ceiling 22 by the lifting of the lifting part 1, so that the installation work of the ceiling-type of lighting apparatus 23 can be simplified.

When the maintenance work is performed at the time of routine inspection or in the event of failure etc. after installation of the ceiling-type of lighting apparatus, the maintenance work of the lighting apparatus 23 including the lifting part 1 can be performed easily on a floor or stand by lowering the lifting part 1.

Fourth Application Example

Figure 8:
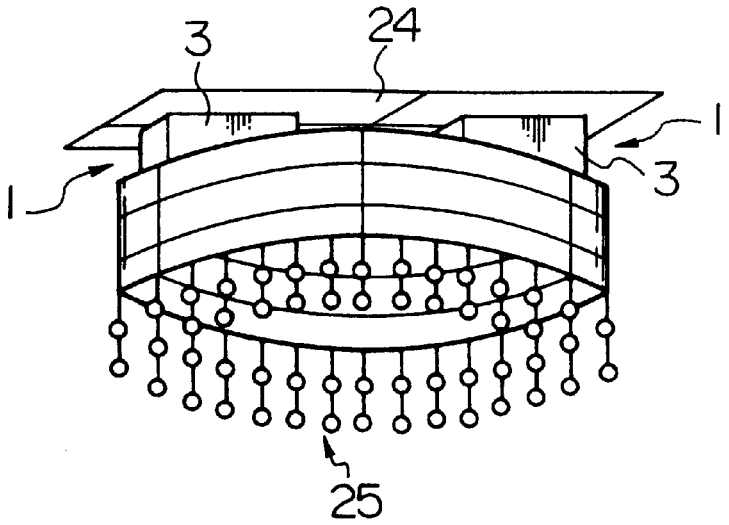
FIG. 8 is a perspective view of a ceiling-type of chandelier, which is a fourth application example of the lifting apparatus shown in FIG. 1.
Figure 9:
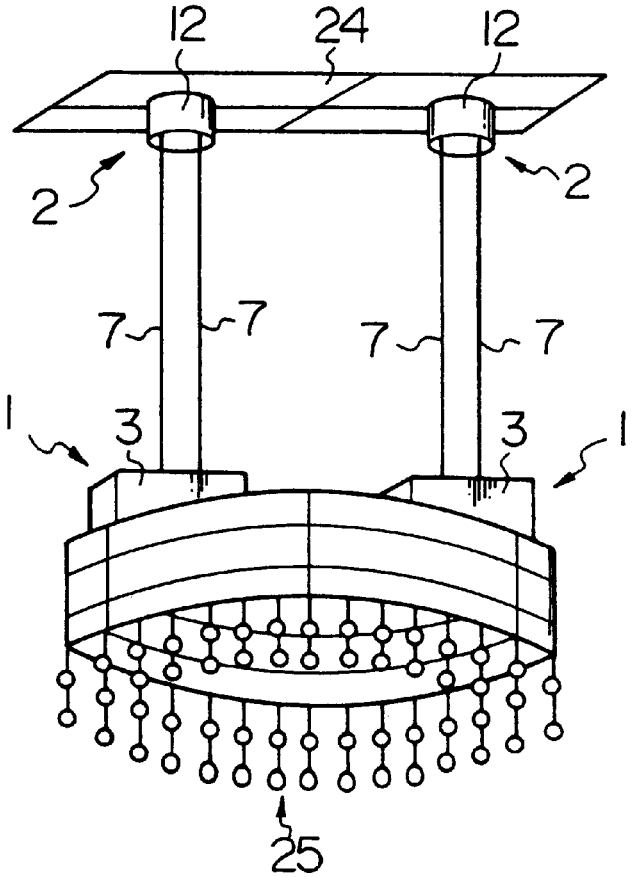
FIG. 9 is a perspective view showing a lowering operation of the chandelier shown in FIG. 8.

FIG. 8 is a perspective view of a ceiling-type of chandelier, which is a fourth application example of the lifting apparatus shown in FIG. 1. FIG. 9 is a perspective view showing a lowering operation of the chandelier.

In FIGS. 8 and 9, like the lifting apparatus shown in FIG. 1, reference numeral 1 denotes a lifting part, 2 denotes a fixed part, 3 denotes a lifting frame, 7 denotes a wire cable, and 12 denotes an upper frame. Further, reference numeral 24 denotes a ceiling, and 25 denotes a chandelier.

In this application example, as shown in the figures, the two upper frames 12 and 12 of the fixed parts 2 and 2 are attached and fixed to the ceiling 24 of a room. On the other hand, the chandelier 25, which is a lighting apparatus, is attached and fixed to the lower surfaces of the lifting frames 3 and 3 of the lifting parts 1 and 1 suspended from the upper frames 12 and 12 through the wire cables 7 and 7, respectively.

Therefore, when the installation work is performed, it is only necessary to fix the small and lightweight fixed parts 2 and 2 (upper frames 12 and 12) to the ceiling 24. After the chandelier 25 is attached to the lower surfaces of the lifting parts 1 and 1 (lifting frames 3 and 3) on a floor or a stand, the chandelier 25 can be installed to the ceiling 24 by the synchronous lifting of the two lifting parts 1 and 1, so that the installation work of the chandelier 25 can be simplified.

When the maintenance work is performed at the time of routine inspection or in the event of failure etc. after installation of the chandelier, the maintenance work of the chandelier 25 including the lifting parts 1 and 1 can be performed easily on a floor or a stand by synchronously lowering the two lifting parts 1 and 1.

Although two sets of lifting apparatus are used in this application example, it is a matter of course that one set of lifting apparatus or three or more sets of lifting apparatus may be used.

Fifth Application Example

Figure 10:
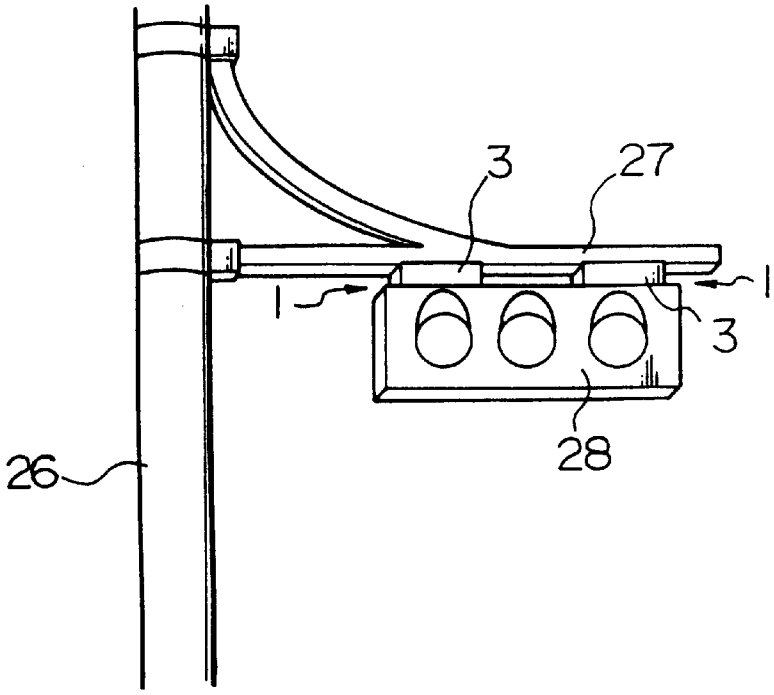
FIG. 10 is a perspective view of a signal, which is a fifth application example of the lifting apparatus shown in FIG. 1.
Figure 11:
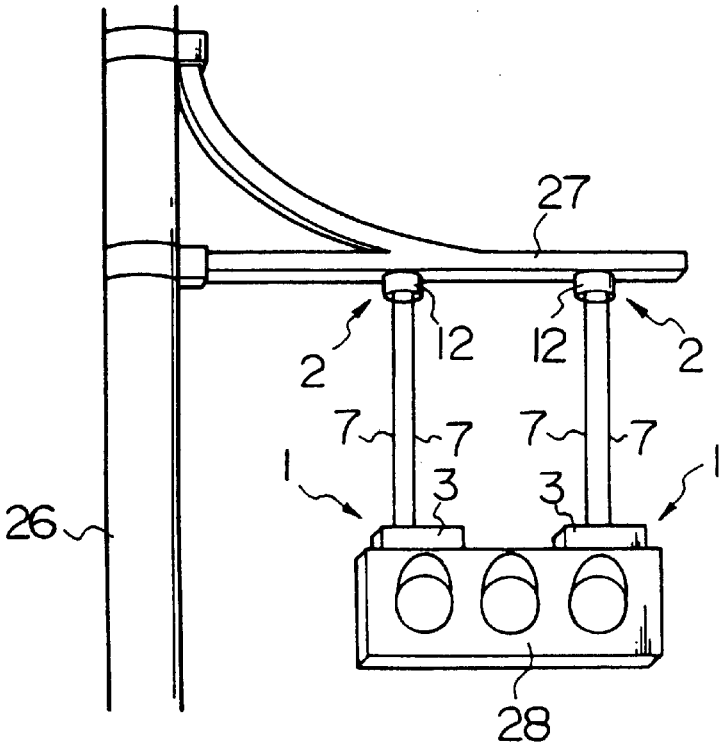
FIG. 11 is a perspective view showing a lowering operation of the signal shown in FIG. 10.

FIG. 10 is a perspective view of a signal, which is a fifth application example of the lifting apparatus shown in FIG. 1. FIG. 11 is a perspective view showing a lowering operation of the signal.

In FIGS. 10 and 11, like the lifting apparatus shown in FIG. 1, reference numeral 1 denotes a lifting part, 2 denotes a fixed part, 3 denotes a lifting frame, 7 denotes a wire cable, and 12 denotes an upper frame. Further, reference numeral 26 denotes a pole, 27 denotes an arm, and 28 denotes a signal.

In this application example, as shown in the figures, the two upper frames 12 and 12 of the fixed parts 2 and 2 are attached and fixed to the lower surface of the arm 27 extending from the upper part of the pole 26. On the other hand, the traffic signal 28, which is a horizontal three lamp type of red, yellow, and blue, is attached and fixed to the lower surfaces of the lifting frames 3 and 3 of the lifting parts 1 and 1 suspended from the upper frames 12 and 12 through the wire cables 7 and 7, respectively.

Therefore, when the installation work is performed, it is only necessary to fix the small and lightweight fixed parts 2 and 2 (upper frames 12 and 12) to the lower surface of the arm 27 at the upper part of the electric-light pole 26. After the traffic signal 28 is attached to the lower surfaces of the lifting parts 1 and 1 (lifting frames 3 and 3) on the ground, the traffic signal 28 can be installed to the pole 26 by the synchronous lifting of the two lifting parts 1 and 1, so that the signal installation work can be simplified.

When the maintenance work is performed at the time of routine inspection or in the event of failure after installation of the signal, the maintenance work of the traffic signal 28 including the lifting parts 1 and 1 can be performed easily on the ground by synchronously lowering the two lifting parts 1 and 1.

Although two sets of lifting apparatus are used in this application example because of the horizontal three lamp type of traffic signal 28, it is a matter of course that one set of lifting apparatus may be used for a vertical three lamp type of traffic signal, or three or more sets of lifting apparatus may be used for the horizontal three lamp type of traffic signal 28.

Other Application Examples

Although the lifting apparatus shown in FIG. 1 has been applied to the road lamps 18 and 21, the ceiling-type of lighting apparatus 23 and 25, and the signal 28 in the above application examples, it is a matter of course that the lifting apparatus can be applied to an air conditioning system attached to a ceiling, an apparatus suspended from a ceiling of a stage or a construction having a large space, furniture, an alarm, a smoke detector, and a signboard, though they are not shown in the figure.

<Second Embodiment>

Figure 12:
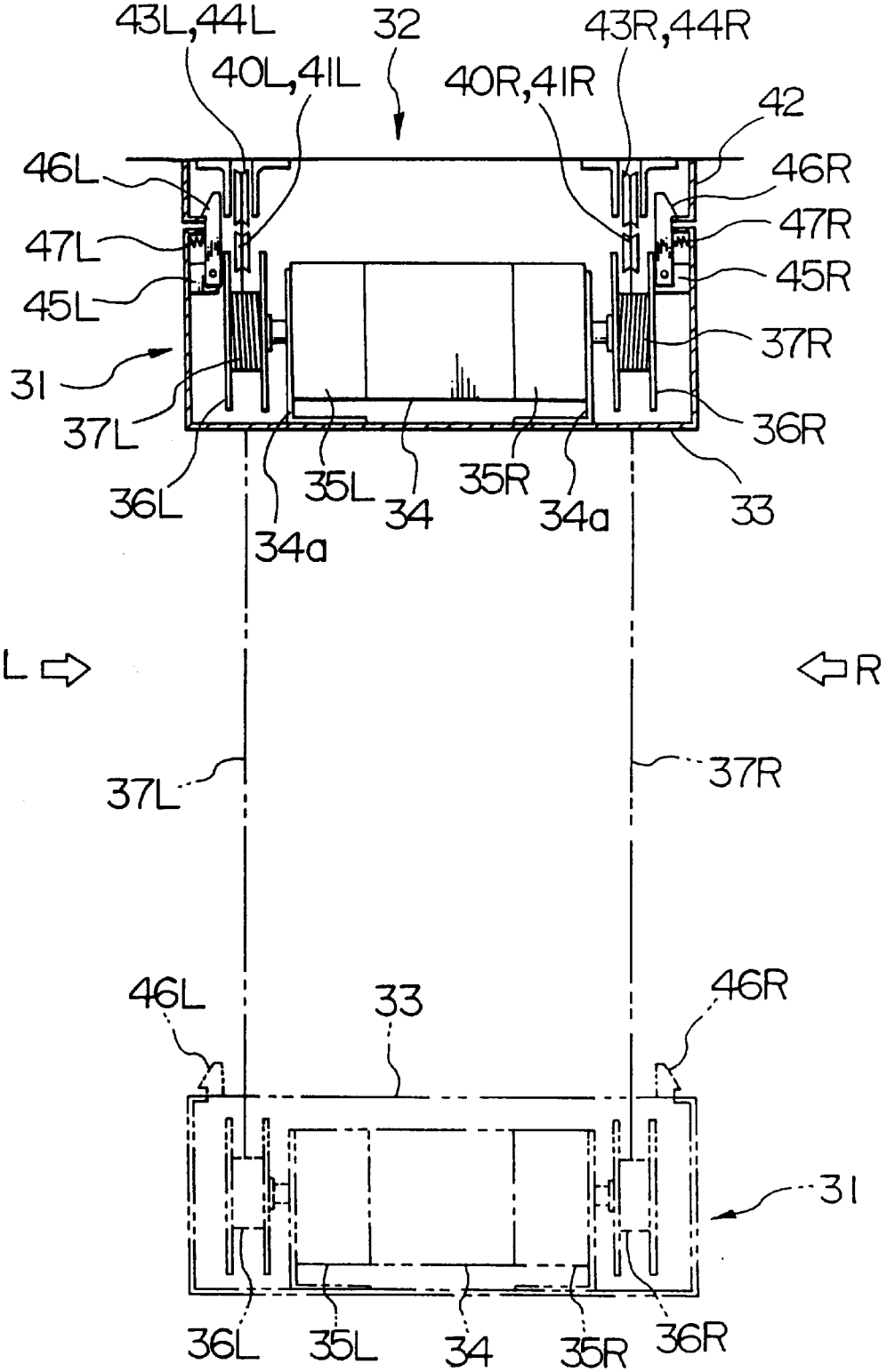
FIG. 12 is a partially broken front view showing a construction of a second embodiment of a lifting apparatus to which the present invention is applied.
Figure 13:
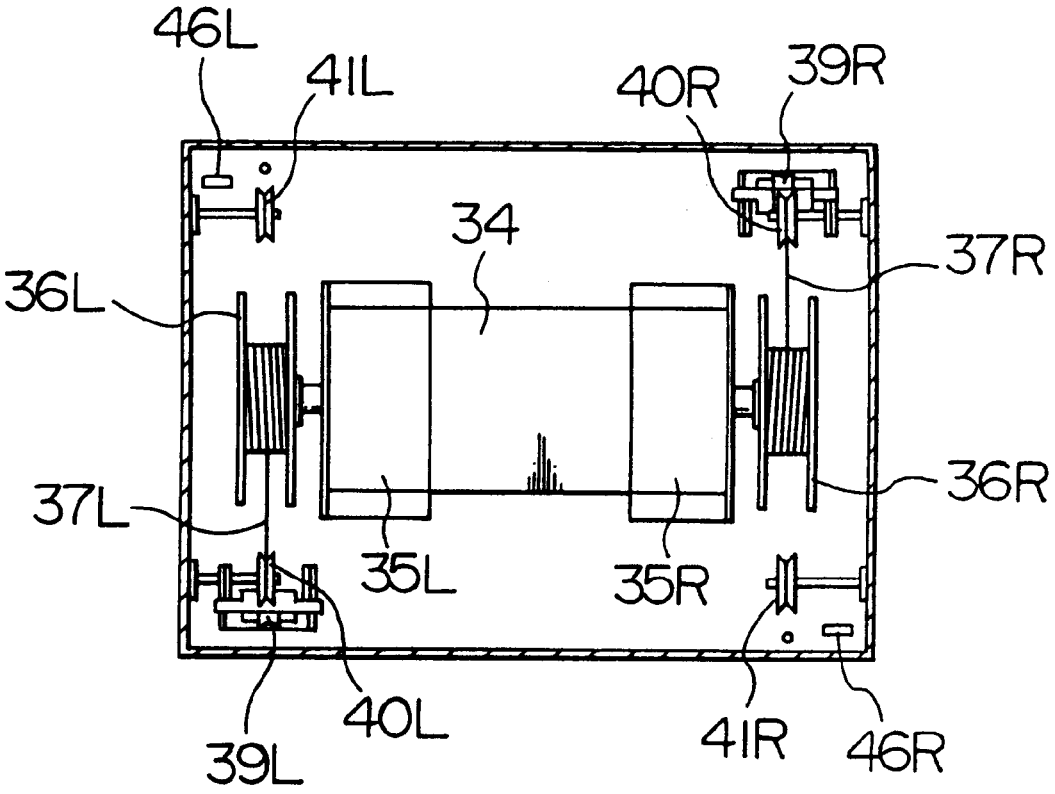
FIG. 13 is a partially broken top plan view of the lifting apparatus shown in FIG. 12.
Figure 14:
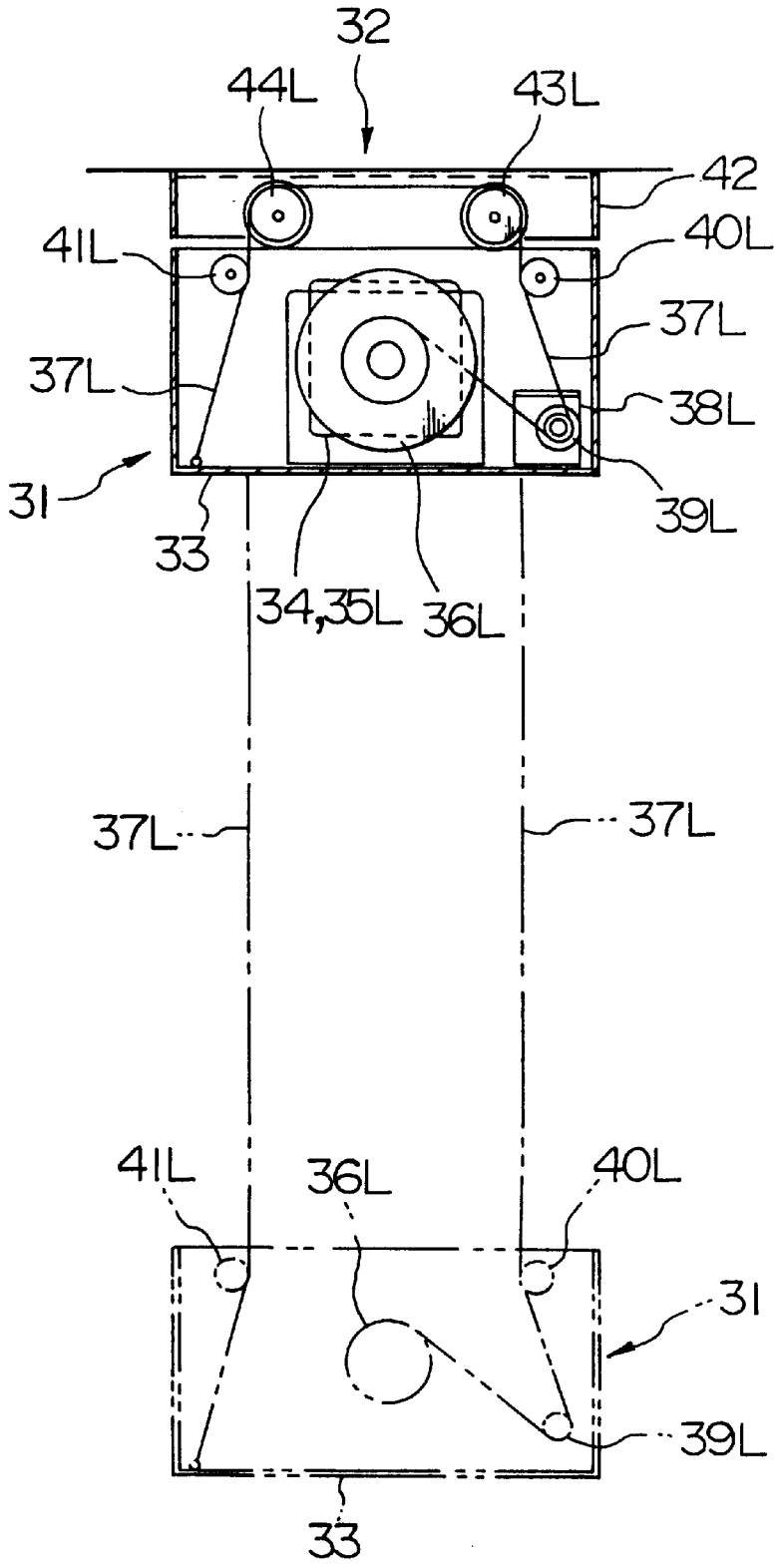
FIG. 14 is a partially broken side view of the lifting apparatus, viewed in the direction of arrow L in FIG. 12.
Figure 15:
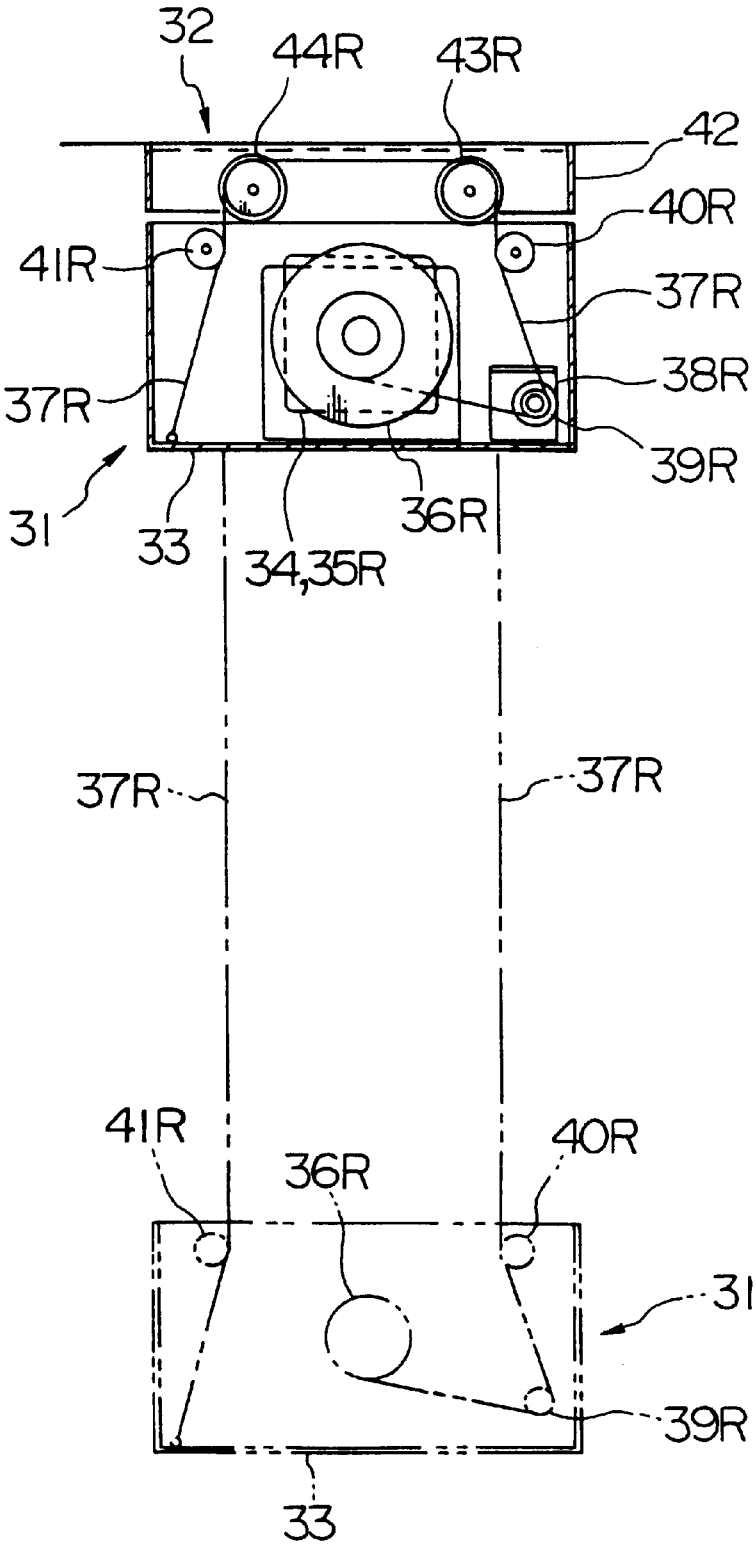
FIG. 15 is a partially broken side view of the lifting apparatus, viewed in the direction of arrow R in FIG. 12.

FIG. 12 is a partially broken front view showing a construction of a second embodiment of a lifting apparatus to which the present invention is applied. FIG. 13 is a partially broken top plan view of the lifting apparatus. FIG. 14 is a partially broken top side view of the lifting apparatus, viewed in the direction of arrow L in FIG. 12. FIG. 15 is a partially broken side view of the lifting apparatus, viewed in the direction of arrow R in FIG. 12.

In FIGS. 12 to 16, reference numeral 31 denotes a lifting part, 32 denotes a fixed part, 33 denotes a lifting frame, 34 denotes an electric motor (power source), 35 (35L and 35R) denotes a speed reducer, 36 (36L and 36R) denotes a driving pulley, 37 (37L and 37R) denotes a wire cable, 38 (38L and 38R) denotes a bracket, 39 (39L and 39R) denotes a random winding preventive pulley, 40 (40L and 40R) and 41 (41L and 41R) denote intermediate pulleys, 42 denotes an upper frame, 43 (43L and 43R) and 44 (44L and 44R) denote intermediate pulleys, 45 (45L and 45R) denotes a bracket, 46 (46L and 46R) denotes a lock lever (locking member), and 47 (47L and 47R) denotes a shape memory alloy spring member.

Like the above-described first embodiment, this lifting apparatus is divided into the lifting part 31 and the fixed part 32 as shown in the figures.

The lifting part 31 is equipped with the electric motor 34, which is a power source, in the center of the interior of the substantially box-shaped lifting frame 33 via a pair of right and left motor brackets 34*a* and 34*a*. At the left and right of the output axis of the electric motor 34, the driving pulleys 36L and 36R are provided via the speed reducers 35L and 35R each having a gear mechanism.

One end of the respective wire cables 37L and 37R is fixed to and wound around these left and right driving pulleys 36L and 36R, and the other end thereof is fixed to a corner positioned on one diagonal line of the lifting frame 33.

Each of the two wire cables 37L and 37R passes around the random winding preventive pulley 39L and 39R which is pivotally mounted to the bracket 38L and 38R erected at the corner positioned on the other diagonal line of the lifting frame 33 and which moves on a shaft, and extends upwardly. Further, each wire cable 37L and 37R passes around the intermediate pulley 40L and 40R, extends upwardly, and, as described later, passes around the intermediate pulleys 43L and 44L, 43R and 44R in the fixed part 32, and further around the intermediate pulley 41L and 41R in the lifting frame 33.

As shown in FIG. 13, the wire cable 37L and 37R wound around each of the left and right driving pulleys 36L and 36R extends to a corner positioned on one diagonal line of the lifting frame 33. That is, the wire cables 37L and 37R extend to the opposite side to each other, so that the lifting frame 33 is less prone to sway when the lifting frame 33 is raised or lowered as compared with the case where the wire cables 37L and 37R are arranged in the same direction.

The fixed part 32 is equipped with the pair of intermediate pulleys 43L and 44L, 43R and 44R at the left and right in the substantially box-shaped upper frame 42. The wire cables 37L and 37R are set around the intermediate pulleys 43L and 44L, 43R and 44R, respectively, as described above.

In the lifting frame 33, the lock levers 46L and 46R which are a pair of locking members protruding upwardly, are provided on the brackets 45L and 45R protrudingly provided at the corner positioned on one diagonal line of the lifting frame 33, respectively.

The pair of lock levers 46L and 46R are normally urged to the locking direction by the tensile force of the shape memory alloy spring members 47L and 47R, respectively. When the shape memory alloy spring members 47L and 47R are heated simultaneously to a predetermined temperature by a heating means using as a releasing means, the shape memory alloy spring members 47L and 47R extend simultaneously. As a result, an unlocking state is established.

The following is an explanation of a locking device.

Figure 16:
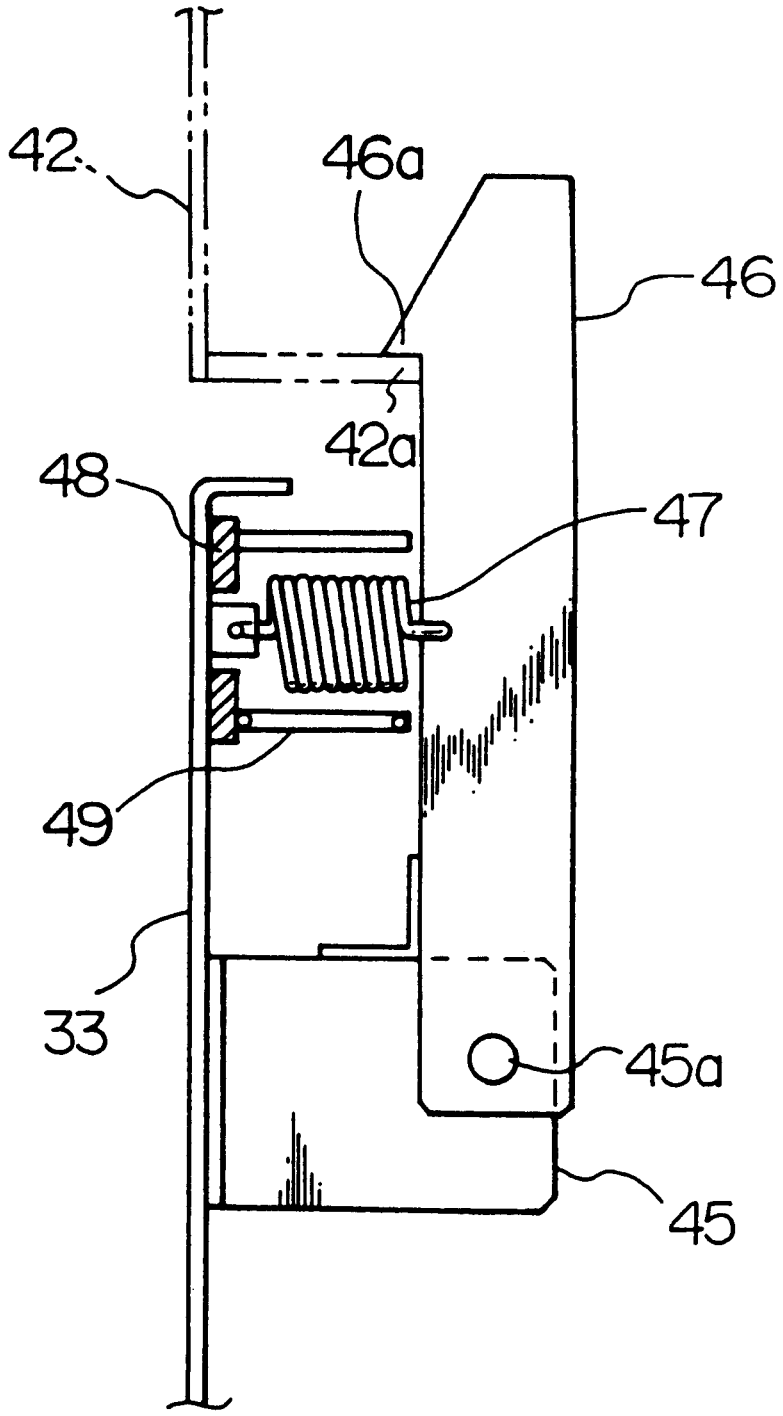
FIG. 16 is an enlarged view showing a locking device portion of the lifting apparatus shown in FIG. 12.
Figure 17:
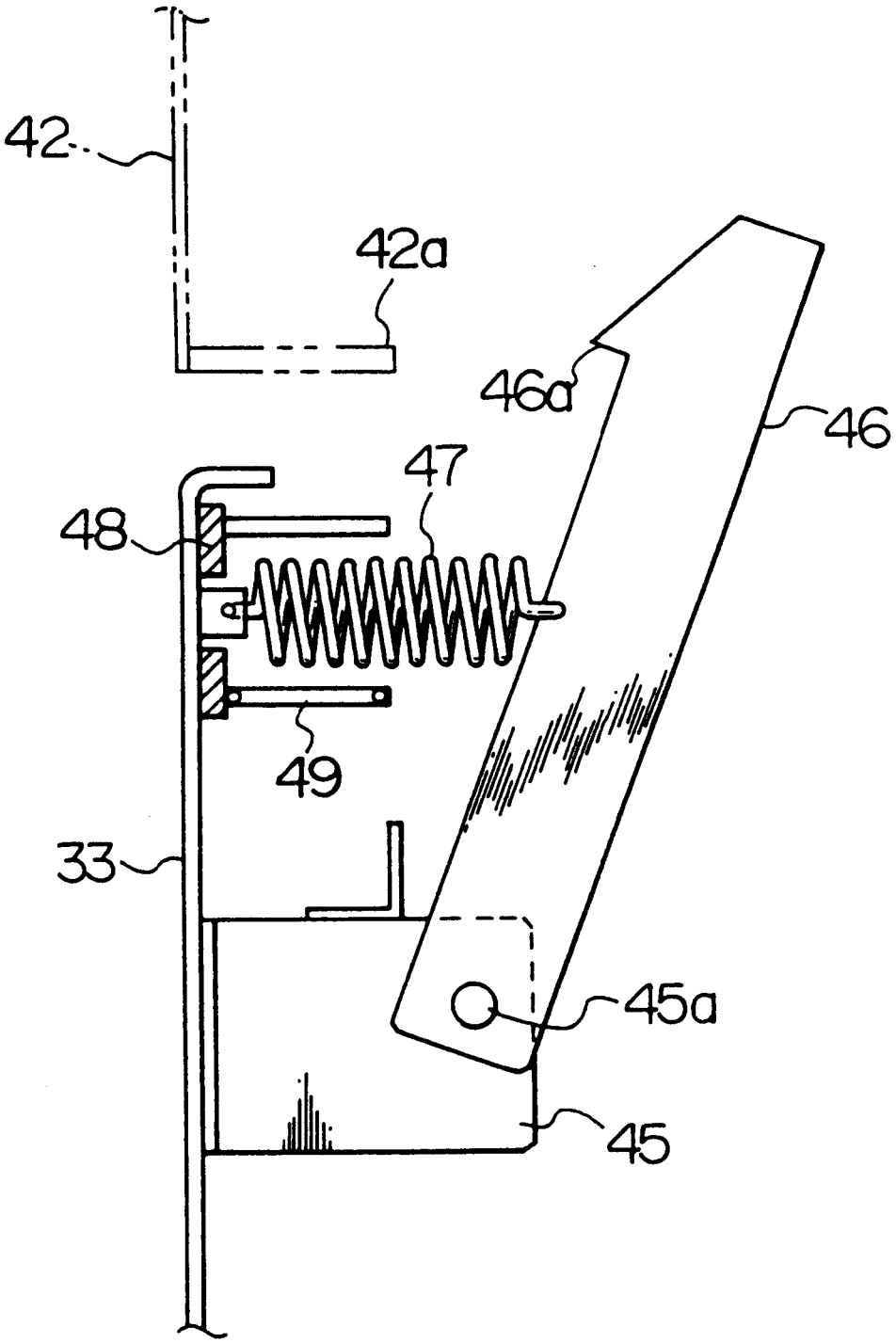
FIG. 17 is a view showing an unlocked state of the locking device shown in FIG. 16.

FIG. 16 is an enlarged view showing a locking device portion of the lifting apparatus shown in FIG. 12. FIG. 17 is a view showing a released state of the locking device.

In FIGS. 16 and 17, as described above, reference numeral 33 denotes a lifting frame, 42 denotes an upper frame, 45 denotes a bracket, 46 denotes a lock lever, and 47 denotes a shape memory alloy spring member. Further, reference numeral 48 denotes an insulating spacer, and 49 denotes an electric heater (heating means).

As shown in FIG. 16, the locking device comprises the lock lever 46 which is attached to a shaft 45*a* of the bracket 45 protruding from the lifting frame 33 so as to be pivotal at the lower end thereof, the shape memory alloy spring member 47 of a compression coil spring shape mounted between the intermediate portion of the lock lever 46 and lifting frame 33, and the coiled electric heater 49, a heating means, which is disposed around the shape memory alloy spring member 47 via the insulating spacer 48 having an electrically and thermally insulating function, which is disposed on the inner surface of the lifting frame 33.

The lock lever 46 has a lock claw 46*a* at the tip end portion thereof. The lock claw 46*a* comes into contact with the upper surface of an inside protruding piece 42*a* of the upper frame 42. Thereby, a locking state is established.

In the lifting apparatus of this embodiment, the operation of the electric heater 49 for unlocking the lock lever 46 is carried out as follows: A receiver (not shown) is mounted in the lifting frame 33 of the lifting part 31, and the heating operation of the electric heater 49 worked by receiving electric waves given a command for lowering operation sent from the aforesaid transmitter, is controlled remotely by radio transmission.

The operation of the electric motor 34 in the lifting part 31 is carried out likewise by remote control using radio transmission. In order to supply electric power to the electric motor 34 and the electric heater 49, a cable reel from a power supply side is introduced to the interior of the lifting frame 33, or a chargeable battery or solar battery is mounted in the lifting frame 33.

As for the electric motor of a unidirectional rotation type having no brake, lifting capacity, limit switch, lifting height of the wire cable 37, configuration of electrodes for connecting the electrical equipment of the elevated installation and the like, this embodiment is the same as the above-described first embodiment.

When the lifting apparatus is installed, the wire cables 37, that is, both of the two left and right wire cables 37L and 37R are extended to a maximum, and the fixed part 32 is fixed by installing the upper frame 42 at a high place by using a scaffold or a vehicle for high lift work.

Subsequently, the electric motor 34 in the lifting part 31 placed at a low place, for example, on the ground is turned on by remote control using radio transmission. Thereby, the driving pulleys 36L and 36R are rotated simultaneously at a low speed via the left and right speed reducers 35L and 35R, respectively. Thereupon, the left and right wire cables 37L and 37R are winched synchronously around the left and right driving pulleys 36L and 36R, respectively, in order to slowly raise the lifting frame 33.

When the lifting frame 33 reaches the position of the upper frame 42 fixed at the high place, the upper limit switch is turned on, and the raising operation carried out by the electric motor 34 is halted. At the same time, the lock claws 46*a* and 46*a* of the pair of lock levers 46L and 46R provided in the diagonal direction of the lifting frame 33 engage with the upper faces of the inside protruding pieces 42*a* and 42*a* in the diagonal direction of the upper frame 42 by tensile force of the shape memory alloy spring members 47L and 47R, so that the lifting frame 33 is fixed to the upper frame 42.

At this time, like the above-described first embodiment, the electrode provided on the lifting frame 33 comes into contact with the electrode provided on the upper frame 42, so that electric power is supplied to electrical equipment mounted in the lifting frame 33.

When maintenance work is done for routine inspection or in the event of failure etc., the electric heaters 49 and 49 for releasing the lock levers 46L and 46R of the lifting frame 33 are energized simultaneously by the remote control using radio transmission. Thereby, the shape memory alloy spring members 47L and 47R are heated, and consequently the shape memory alloy spring members 47 (47L and 47R) are deformed so as to extend as shown in FIG. 17.

Thereupon, the lock levers 46 (46L and 46R) are pivoted around the shaft 45*a*, by which the lock claws 46*a* and 46*a* are disengaged simultaneously from the upper surfaces of the inside protruding pieces 42*a* and 42*a* of the upper frame 42.

Thus, like the above-described first embodiment, the electric motor 34 is rotated reversely by self-weight of the lifting part 31 via the resistance due to a predetermined speed reduction ratio of the gear mechanism of the speed reducer 35L and 35R, whereby the lifting part 31 is lowered slowly.

While the lifting part 31 is placed at a low place, for example, on the ground, a predetermined maintenance work is performed.

After the maintenance work is completed, reinstallation work is performed by the same procedure as described above.

Like the lifting apparatus of the above-described first embodiment, the lifting apparatus of the second embodiment can, needless to say, be applied to the road lamps 18 and 21, the ceiling-type of lighting apparatuses 23 and 25, and the signal 28. Moreover, the lifting apparatus of the second embodiment can be applied to an air conditioning system attached to a ceiling, an apparatus suspended from a ceiling of a stage or a construction having a large space, furniture, an alarm, a smoke detector, and a signboard.

As described above, the lifting apparatus of the second embodiment can achieve approximately the same advantageous effects as those of the above-described first embodiment.

Although the locking device using the lock lever with a torsion coil spring or the lock lever with a spring made of shape memory alloy has been provided in the above embodiments, the present invention is not limited to this configuration, and a locking device of any other configuration may be used.

Also, although the lifting apparatus of one-motor driving system has been provided in the above embodiments, a lifting apparatus of synchronous two-motor driving system may be provided. Further, it is a matter of course that modifications can be made appropriately on other specific detailed constructions and the like.

What is claimed is:

1. A lifting apparatus, comprising:

a fixed part to be fixed at a height above a surface;

a lifting part including:

an installation to be installed at the fixed part;

a frame;

an electric motor on the frame that is rotatable driven in only one direction to move the lifting part upwardly relative to the surface; and a battery on the frame for supplying electric power to the electric motor;

wherein the lifting part being suspended from the fixed part by a wire cable to move up and down relative to the surface;

a locking device for locking the lifting part to the fixed part;

the wire cable being winched by driving the electric motor through a speed reducer on the frame;

wherein the lifting part is downwardly movable by the self-weight of the lifting part toward the surface by releasing the locking of the lifting part to the fixed part.

2. A lifting apparatus as claimed in claim 1, wherein the locking device comprises a locking member for locking the lifting part to the fixed part, and a releasing member for releasing the locking of the lifting part to the fixed part.

3. A lifting apparatus as claimed in claim 2, wherein the releasing member comprises a solenoid for releasing the locking of the lifting part to the fixed part by electromagnetic force thereof.

4. A lifting apparatus as claimed in claim 2, wherein the releasing member comprises a heater for activating the locking member to release the locking of the lifting part to the fixed part.

5. A lifting apparatus as claimed in claim 2, wherein the releasing member comprises a shape memory alloy spring connected to the locking member, the spring normally maintaining the locking of the lifting part to the fixed part, and the spring being deformed when heated above a predetermined temperature by the heater, to release the locking of the lifting part to the fixed part.

6. A lifting apparatus as claimed in claim 2, further comprising a control member for controlling the releasing member by remote control.

7. A lifting apparatus as claimed in claim 2, further comprising a power supply for supplying electric power to the releasing member.

8. A lifting apparatus as claimed in claim 7, wherein the power supply is a chargeable battery or a solar battery.

9. A lifting apparatus as claimed in claim 1, wherein the speed reducer reduces the moving speed of the lifting part.

10. A lifting apparatus as claimed in claim 1, wherein the installation is selected from the group consisting of a road lamp, a lighting apparatus to be attached to a ceiling, a signal, an air conditioning system to be attached to a ceiling, an apparatus to be suspended from a ceiling for a stage and a construction having a large space, furniture, an alarm, a smoke detector and a signboard.

11. A lifting apparatus as claimed in claim 1, wherein the electric motor is rotated reversely by the self-weight of the lifting part through a resistance due to the speed reducer when the locking device is unlocked.

12. A lifting apparatus, comprising:

a fixed part to be fixed above a surface;

a lifting part attachable to an installation to be installed at the fixed part, the lifting part including:

a frame;

a motor on the frame that is rotatably driven in only one direction to move the lifting part upwardly relative to the surface; and a power source on the frame for powering the motor;

wherein the lifting part is suspended from the fixed part by a wire cable to move upward and downward relative to the surface;

a locking device for locking the lifting part to the fixed part above the surface;

the wire cable being raised by the motor when the motor is rotatably driven in the one direction, wherein the lifting part is downwardly movable by the self-weight of the lifting part toward the surface by releasing the locking of the lifting part to the fixed part.

13. A lifting apparatus as claimed in claim 12, wherein the motor is rotated reversely by the self-weight of the lifting part through a resistance due to a predetermined speed reduction ratio of a gear mechanism of a speed reducer when the locking device is unlocked.

14. A lifting apparatus, comprising:

a fixed part to be fixed above a surface;

a lifting part attachable to an installation to be installed at the fixed part, the lifting part including:

a frame;

a motor on the frame that is rotatably driven in only one direction to move the lifting part upwardly relative to the surface; and a power source on the frame for powering the motor;

wherein the lifting part is suspended from the fixed part by a wire cable to move upward and downward relative to the surface;

a locking device for locking the lifting part to the fixed part above the surface;

the wire cable being raised by the motor when the motor is rotatably driven in the one direction; and the motor is rotated reversely by the self-weight of the lifting part through a resistance due to a speed reducer when the locking device is unlocked.

15. A lifting apparatus, comprising:

a fixed part to be fixed at a height above a surface;

a lifting part that is releasably locked to the fixed part, the lifting part including:

an installation to be installed at the fixed part;

a frame;

an electric motor on the frame, the electric motor is drivable in only one direction to move the lifting part upwardly relative to the surface; and a battery on the frame for supplying electric power to the electric motor;

wherein the lifting part being suspended from the fixed part by a wire cable to move up and down relative to the surface;

the wire cable being winched by driving the electric motor through a speed reducer on the frame;

the lifting part is downwardly self-movable toward the surface by releasing the locking of the lifting part to the fixed part.

16. A lifting apparatus as claimed in claim 15, wherein the electric motor is rotated reversely by the self-weight of the lifting part through a resistance due to a speed reducer when the lifting part is unlocked from the fixed part.

* * * * *